United States Patent [19]

Sinharoy et al.

[11] Patent Number: 4,699,763

[45] Date of Patent: Oct. 13, 1987

[54] CIRCUIT BREAKER CONTACT CONTAINING SILVER AND GRAPHITE FIBERS

[75] Inventors: Semahat D. Sinharoy, Monroeville; Jere L. McKee, Scott Township, Lawrence County; Norman S. Hoyer, Mt. Lebanon, all of Pa.

[73] Assignee: Westinghouse Electric Corp., Pittsburgh, Pa.

[21] Appl. No.: 878,103

[22] Filed: Jun. 25, 1986

[51] Int. Cl.[4] ..... B22F 1/00

[52] U.S. Cl. ..... 419/11; 419/4; 419/24; 419/28; 419/29; 419/32; 419/36; 419/38; 419/44; 419/54; 419/55; 75/243; 252/503; 252/514

[58] Field of Search ..... 419/4, 24, 11, 55, 28, 419/29, 32, 36, 38, 44, 54; 75/229, 243

[56] References Cited

U.S. PATENT DOCUMENTS

| | | | |
|---|---|---|---|
| 2,370,400 | 2/1945 | Graves | 75/229 |
| 2,621,123 | 12/1952 | Hoyer | 75/221 |
| 2,818,633 | 1/1958 | Hoyer | 29/182 |
| 3,963,449 | 6/1976 | Seki et al. | 75/234 |
| 4,083,719 | 4/1978 | Arakawa et al. | 75/229 |
| 4,457,780 | 7/1984 | Osada et al. | 75/236 |

OTHER PUBLICATIONS

Electrical Contacts, Metals Handbook, 9th Ed., vol.7, pp. 630–634.

Electrical-Contact Materials, Metals Handbook, 9th Ed., vol. 3, pp. 663–693.

Doduco-Dr. E. Dorrwachter Doduco KG; D 7530 Pforzheim, Postfach 480.

*Primary Examiner*—Stephen J. Lechert, Jr.

*Attorney, Agent, or Firm*—L. P. Johns

[57] ABSTRACT

An electrical contact material characterized by a pressed and sintered powder of silver composite with about 5 weight percent of graphite fibers.

6 Claims, 4 Drawing Figures

CIRCUIT BREAKER CONTACT CONTAINING SILVER AND GRAPHITE FIBERS

BACKGROUND OF THE INVENTION

1. Field of the Invention

This invention pertains to electrical contact materials for use in switches and molded case circuit breakers and, more particularly, it pertains to graphite fibers in a silver matrix.

2. Description of the Prior Art

Circuit breakers include electrical contacts that make, carry, and break electrical circuits passing through the circuit breaker. The contacts are made of either elemental metal, composites, or alloys that are derived by the metal-cast method or manufactured by powder metallurgy processes. The ideal metal or metal combination that can function as a perfect contact material under all conditions does not exist. Therefore, an evaluation and understanding of the operating conditions of an electrical contact device including economic considerations is necessary before selecting the most suitable contact material.

Historically, contact materials have consisted almost entirely of silver, silver alloys, and powder metallurgically sintered combinations. Exceptions include some beryllium copper, phosphor bronze, and nickel materials that are also used as contacts. Silver-type contacts, include the pure metal, alloys, and metal powder combinations comprise the majority of contact applications in the electrical industry. Other types of contacts used include platinum group metals, tungsten, molybdenum, copper, copper alloys, and mercury. For more information on electrical contact materials, reference is made to "Electrical-Contact Materials" in volume 3 of the 9th edition of METALS HANDBOOK, published by the American Society for Metals.

Powder metallurgy facilitates combinations of silver as well as copper with other metals. These diverse combinations ordinarily cannot be achieved by alloying. When silver is combined with other metals with which it does not conventionally alloy, powder metallurgy procedures may be employed to combine the characteristics of silver with the other metals in a manner in which true alloys cannot duplicate. Moreover, the chemical characteristics of the metal remain unchanged in powder metallurgy combinations. The electrical conductivity of the silver in powder metallurgy combinations is unchanged, so that the resulting conductivity may be only moderately less than than of the pure silver.

In the past, graphite and silver have been combined, by powder metallurgy techniques. The most frequently used composition is 95% silver and 5% graphite, although graphite combinations ranging from 0.25 to 90% with the remainder silver have been used. The advantage of graphite is that it prevents welding. However, silver graphite combinations are soft compared to other types of graphite materials and electrical and mechanical erosion is more rapid. Moreover, the silver graphite combinations exhibit inferior wear resistance though offering better protection against welding.

SUMMARY OF THE INVENTION

It has been found in accordance with this invention that an electrical contact material is provided which comprises pressed and sintered powder having from about 0.5 to about 10 weight percent of graphite fiber particles, and from about 0.1 to about 3 weight percent of powdered wetting agent selected from the group consisting of Ni, Fe, Co, Cu, Au, and mixtures thereof. and the residual part consisting essentially of silver.

It has also been found that a method may be provided for producing an electrical contact material of silver and graphite fiber which method comprises the steps of (1) mixing quantities of a powder of silver, graphite fiber particles, wetting agent powder, a solution of a lubricant and a solvent to provide a homogeneous mixture of ingredients and including from about 0.5 to 10 weight percent graphite fiber particles, from about 0.1 to 3 weight percent powdered wetting agent selected from the group consisting of nickle, iron, cobalt, copper, gold, and mixtures thereof, the solution being a slurry of a volatile hydrocarbon solvent and of a lubricant selected from the group consisting of polyethylene, paraffin, stearic acid, and the residual part consisting of a powder of silver; (2) drying the mixture of ingredients to eliminate the volatile solvent and to produce a dried mixture; (3) screening the dried material to agglomerate the ingredients into clusters; (4) pressing the clusters of dried material under a pressure of from about 7.5 to 10 tsi to form a solid briquet; (5) heating the solid briquet from about 250° F. to 450° F. for about one hour at each temperature of 250° F., 350° F., and 450° F. to bake out the lubricant; (6) sintering the solid briquet at a temperature range of from about 1500° F. to 1700° F. in a reducing atmosphere to shrink the briquet to a higher density; (7) repressing the solid briquet under a pressure of about 50 tons per square inch to increase the density; (8) resintering the solid briquet at a temperature of from about 1500° F. to 1700° F. in a reducing atmosphere to anneal stresses from the repressing step; (9) re-repressing the solid briquet under a pressure of from about 50 to 60 tons per square inch to further increase the density; and (10) applying a solder shim to one side of the solid briquet to facilitate subsequent mounting of the solid briquet on a contact mounting arm. The contact material may also be fabricated by extrusion 11 or rolling 12.

The advantage of a contact having graphite fibers is that it has increased resistance to electrical erosion and not only has higher strength, but also temperature rise and erosion due to make-and-break of a circuit are minimal.

DESCRIPTION OF THE PREFERRED EMBODIMENT

In accordance with this invention a method for producing an electrical contact material of silver and graphite fiber comprises the following steps:

(1) mixing quantities of silver powder A, graphite fiber particles B, wetting agent powder C, a solution of a lubricant D, and a solvent E to provide a homogeneous mixture of ingredients and including from about 0.5 to about 10 weight percent of graphite fiber particles, from about 0.1 to about 3 weight percent of powdered wetting agent selected from the group consisting of Ni, Fe, Co, Cu, Au, and mixtures thereof, the solution being a slurry of a volatile hydrocarbon solvent and of a lubricant selected from the group consisting of polyethylene glycol, paraffin, and stearic acid, and the residual part consisting of silver powder;

(2) drying the mixture of ingredients to eliminate the volatile solvent and to produce a dried mixture;

(3) screening the dried mixture to agglomerate the ingredients into clusters;

(4) pressing the dried mixture under a pressure of from about 7.5 to about 10 tons per square inch to form a solid briquet;

(5) baking the solid briquet from about 250° F. to about 450° F. for about one hour at each temperature of 250° F., 350° F., and 450° F., in air to bake out the lubricant;

(6) sintering the solid briquet at temperature range of from about 1500° F. to 1700° F. in a reducing atmosphere to shrink the briquet to a higher density;

(7) repressing the solid briquet under a pressure of about 50 tons per square inch to increase the density;

(8) resintering the solid briquet at a temperature of from about 1500° F. to about 1700° F. in a reducing atmosphere to anneal stress from repressing;

(9) re-repressing the solid briquet under a pressure of from about 50 to 60 tons per square inch; and

(10) applying a solder shim to one side of the solid briquet to facilitate subsequent brazing of the briquet onto a contact support arm.

The foregoing method provides an electrical contact material comprising pressed and sintered powder of graphite fiber having a working range of from about 0.5 to about 10 weight percent, or an optimum range of from about 3 to 7 weight percent, or a preferred amount of about 5 weight percent graphite fiber, 0.5 weight percent to 1.5 weight percent of wetting agent, such as Ni, Fr, Co, Cu, Au, and mixtures thereof, and the residual part consisting essentially of silver.

Figure 1:
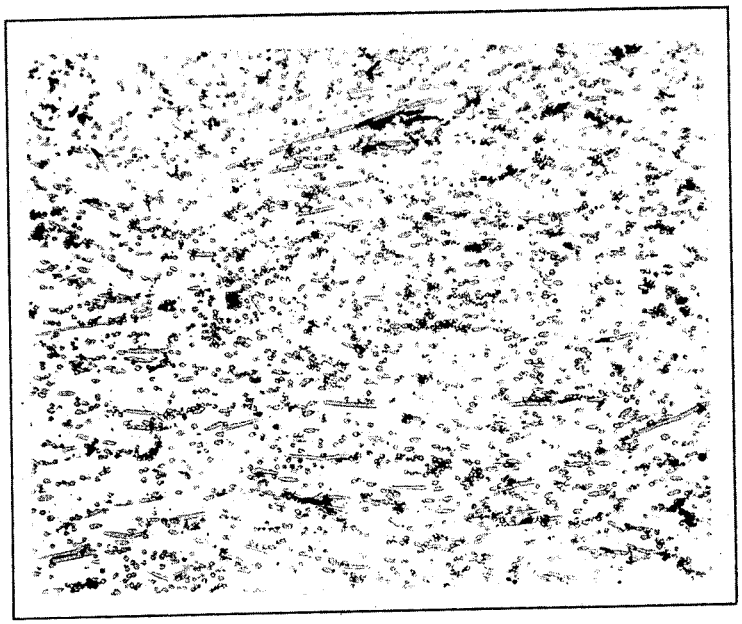
FIG. 1 is a photo micrograph at 100 magnification of silver and graphite fiber contact taken in a horizontal plane.
Figure 2:
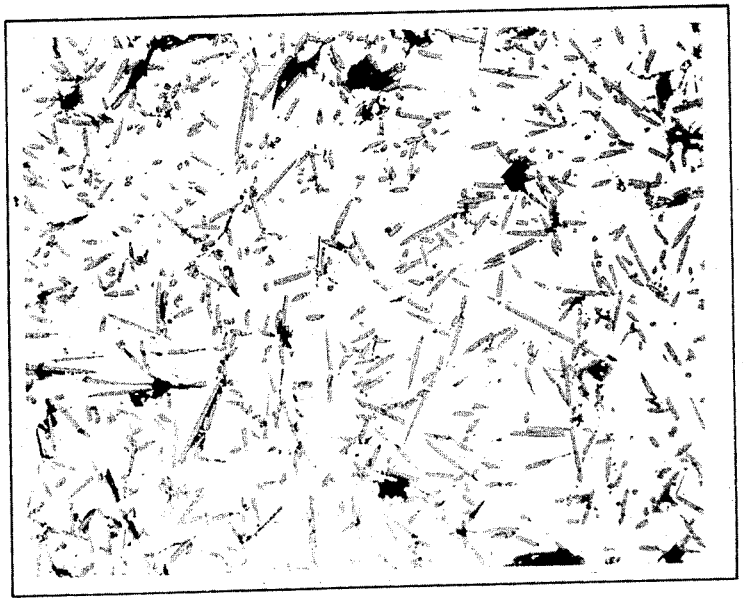
FIG. 2 is a photo micrograph at 100 magnification of a silver and graphite fiber contact in a transverse plane.
Figure 3:
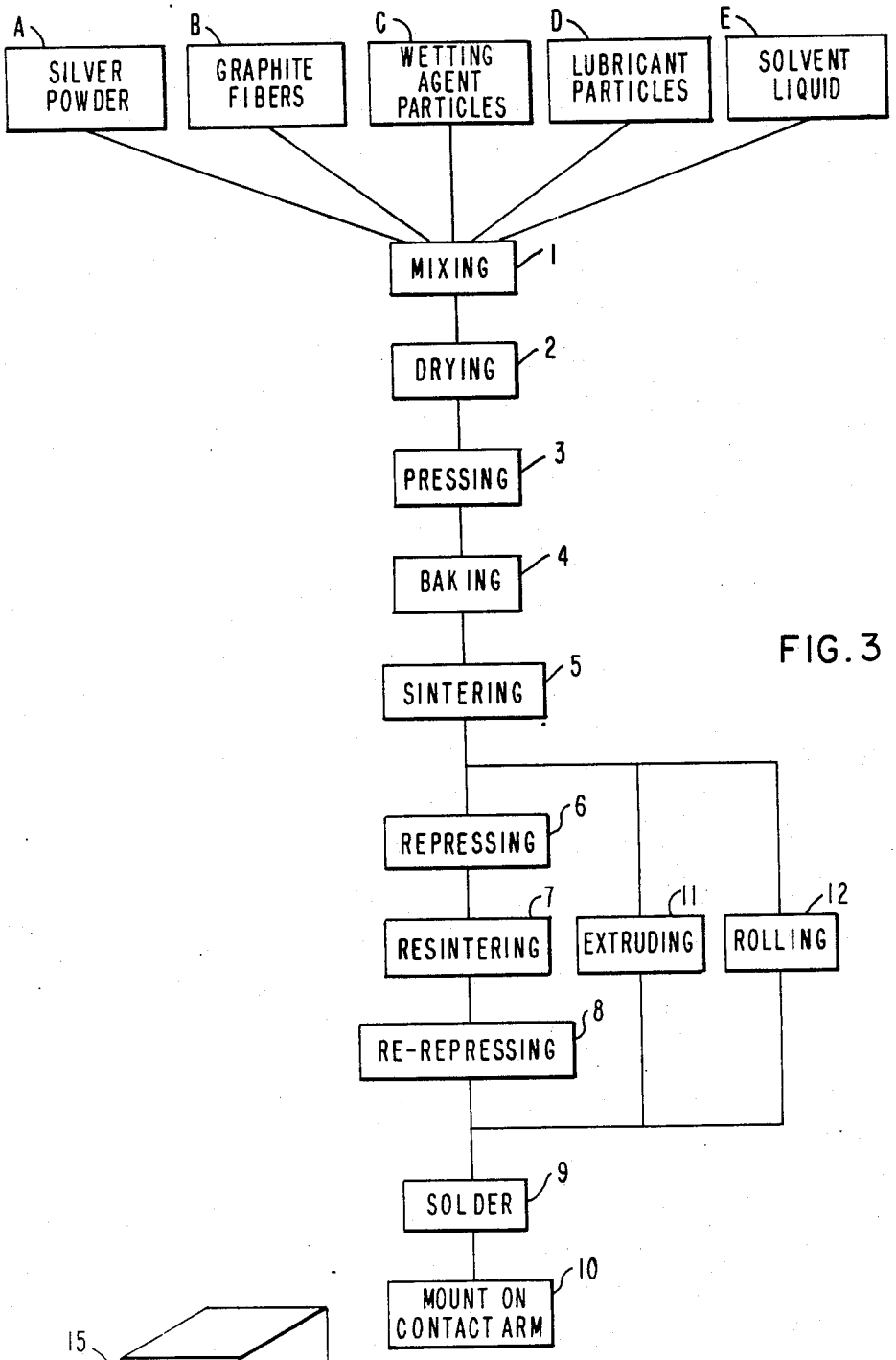
FIG. 3 is a diagram of the several steps involved in the method of preparing an electrical contact by powder metallurgical procedures.

In FIGS. 1 and 2 the photo micrographs show a white matrix of silver with elongated or needle-like deposits of graphite fibers. FIGS. 1 and 2 disclose a typical contact microstructure in two directions. The graphite fibers maintain their shapes during fabrication and interlock with each other in three dimensions. FIGS. 1 and 2 show photo micrographs of 5 weight percent graphite fiber in a silver matrix of the contacts in horizontal and transverse directions, respectively. Although the wetting agent is present in an amount of about 0.5%, it is not shown in the matrix. Silver and nickel normally do not alloy because the powder metallurgy process involved does not reach sufficiently high temperatures to cause melting of either metal. Moreover, all graphite is in fibrous form, no powdered graphite has been added. Indeed, graphite fibers are proposed as an alternative material to graphite powder, because it was found that graphite powder had less resistance to erosion than graphite fiber due to the interlocking effect of the fibers in the matrix as shown in FIGS. 1 and 2.

The fibers have an average length of about 0.2 micrometers (0.008 inch) or micron size with a diameter of about 7–8 microns. It is pure graphite, such as that supplied by Great Lakes Carbon Corporation of Rockford, Tenn. The amount of graphite fiber may vary from a working range of 0.5 to 10 weight percent and is used as electrical contacts in most circuit breakers where a silver graphite contact is required.

The method by which the contacts are produced generally involves the steps of mixing micron sized graphite fibers with silver powder, wetting agent, and a lubricant which is pressed into green contacts which are baked, sintered, repressed, resintered, re-repressed, and solder flushed to achieve good material, thermal, and electrical properties, making them very favorable contacts for molded case breaker applications. The silver powder is preferably 99.9% pure.

The wetting agent improves adherence between the silver powder particles resulting in an overall strengthening of the contacts during sintering and resintering. The wetting agent includes such metals as nickel, iron, cobalt, copper, and gold in powdered form. For convenience, nickel only is mentioned below and it is understood that the other metals, i.e., iron, cobalt, copper, and gold, are substitutes. It comprises from 0.1 to 3 weight percent and preferably 0.5 weight percent, of the total mixture of all ingredients added. The powder size is comparable to that of the silver powder such as about 3 to 4 microns. As a result of sintering, pressing and resintering, the wetting agent strengthens the silver matrix. The size of the silver and wetting agent powder is micron size or about 3.8 microns average particle size.

The lubricant is added to coat the surfaces of the silver, nickel, powders and graphite fibers, to obtain a uniform mix and prevent separation thereof. The lubricant is preferably an organic material, such as polyethylene glycol, paraffin, stearic acid, and is mixed with a hydrocarbon solvent, such as chlorinated and aromatic hydrocarbon in an amount sufficient to provide a slurry or syrupy mix. The lubricant is added in an amount of about 1.5% of the total powder weight of the ingredients. During the mixing step of the several ingredients including the powders of silver wetting agent, and graphite fibers, the lubricant is uniformly dispersed to coat the surfaces of all of the particles and powder in the mixture. More particularly, silver powder has a density of 10.5 $gm/cm^3$ and graphite fiber particles have a density of 1.78 $gm/cm^3$ so that during mixing and handling there is a tendency due to gravity for the silver and graphite to separate. For that reason, lubricant is added to coat the powder surfaces and prevent separation of the silver powder and graphite fiber particles and thereby derive a uniform mixture. It is necessary that a homogeneous mixture of all ingredients be obtained so that each contact has essentially the same chemical composition. The lubricant facilitates the flow of the ingredients during pressing and facilitates agglomeration.

After mixing the mixture is dried to evaporate the volatile solvent. For that purpose the wet mixture of ingredients is preferably spread out on a flat surface and allowed to air dry to form a solid cake-like mixture.

After drying the mixture is agglomerated by screening to form agglomerates or clusters of particles of silver, graphite fibers, wetting agent, and the lubricant. The resulting clusters have more uniform dispersements of the ingredients and improve flowing or sliding during the subsequent pressing process.

The dried cluster of ingredients is then pressed under a pressure of from about 7.5 to about 10 tons/inch squared into a solid briquet. The pressing occurs at room temperature and avoids subsequent crumbling of the clusters during subsequent steps.

Subsequently, the briquets are heated at a temperature range of from about 250° F. to 450° F. Heating occurs for one hour at each temperature of 250° F., 350° F., and 450° F. The purpose of the heating is to bake out the lubricant leaving the remaining particles or powders of silver, nickel, and graphite fibers. Heating above 450° F. such as at 600° F. causes the lubricant to bake out too fast, resulting in an internal structure that subsequently forms internal voids, fissures, and cracks.

The briquets are then sintered in a temperature ranging from about 1500° F. to about 1700° F. in a reducing atmosphere in order to strengthen the bonding between the silver and graphite fibers. The preferred sintering temperature is 1600° F. The sintering temperature is not possible prior to removal of the lubricant. The reducing atmosphere is preferably dissociated ammonia ($NH_3$). Sintering results in a stronger structure and shrinkage of the briquet into a contact sized member having a higher density than the solid briquet prior to sintering.

After sintering the resulting contact is repressed at a higher pressure of about 50 tons per square inch at room temperature to increase the density of the contact. The higher the density, the better resistance to erosion for which reason it is desirable to obtain a density at close to theoretical density as possible.

After repressing the contact is resintered at a temperature of from about 1500° F. to about 1700° F. in a reducing atmosphere in order to anneal stresses resulting from the previous repressing step and a further bonding of the particles.

After resintering the contact is re-repressed to increase the density to almost theoretical density range (94–98%) by re-repressing at 50–60 tsi pressure.

Figure 4:
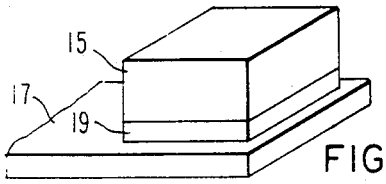
FIG. 4 is a isometric view of a contact having a solder shim added to one side thereof and mounted on a contact arm.

After re-repressing the contact 15 (FIG. 4) is ready for mounting on a contact arm 17 by a braze joint. For that purpose it is necessary to apply a shim or layer 19 of solder having a thickness of about 0.003 to 0.004 inch. The solder is generally an alloy of silver and copper and enables ultimate brazing of the contact 15 onto the contact arm 17.

With regard to the material properties of the contacts having an average graphite fiber content of about 5 weight percent, the density approaches 98% theoretical density which is achieved after the re-repressing operation. With the silver/graphite powder contacts of prior art structure it was difficult to achieve 98% theoretical density by the foregoing similar manufacturing techniques.

Hardness readings were taken after re-repressing with Rockwell 15T scale. The hardness range changed from 50 to 66 depending upon the density, the pressing pressure, and other variables.

Electrical conductivity of 53 to 58% of IACS can be achieved after re-repressing.

The contacts are cut, mounted, and polished in two directions to provide an unusual microstructure (FIGS. 1, 2). The fibers maintain their shapes and interlock with each other in three dimensions in the horizontal and transverse directions.

The contacts were brazed to conductors, such as contact arms 17, and assembled into a 250A molded case circuit breaker with stationary main contacts and electrically tested for UL submittal. The test data is shown in Tables 1 and 2.

TABLE 1

| TEST CIRCUIT VOLTS/AMPS | DATA NO. | TIME TO INTER-RUPTION MILLISECONDS | PEAK CURRENT K AMPS | ARC VOLTAGE | LET-THROUGH ENERGY $I^2t \times 10^6$ | INTER RUPTION ENERGY (JOULES) $\times 10^4$ |
|---|---|---|---|---|---|---|
| 600/50,000 | Test Close-Open 3009 | 6.7 | 40.4 | 734 | 3.84 | 5.92 |
| 480/65,000 | 5001 Open | 6.8 | 41.4 | 656 | 3.12 | 4.57 |
| | 5002 Close-Open | 5.1 | 39.8 47.6 | 672 | 4.56 | 4.67 |
| 600/50,000 | 5003 Open | 7.3 | 36.9 | 697 | 4.25 | 7.12 |
| 600/50,000 | 5004 Open | 23 | 8.59 | 461 | .397 | .592 |
| | 5005 Close-Open | 23 | 8.48 | 406 | .445 | .859 |
| | 5006 Open | 21.3 | 9.47 | 469 | .514 | .665 |
| | 5007 Close-Open | 19.8 | 8.78 | 398 | .404 | .691 |
| 600/25,000 | 5008 Open | 10.4 | 30.8 | 594 | 2.8 | 5.24 |
| | 5009 Close-Open | 11.1/14 | 29.61 26.15 | 632 | 2.7 | 4.69 |

Table 1 lists contact contact evaluation test results under short circuit conditions and shows that contacts performed well. Although the contacts were subjected to severe tests, they had only minor erosion and no cracks, chips, laminations, or fissures.

TABLE 2

| | POLE | Breaker No. A | Breaker No. I | COMMENTS |
|---|---|---|---|---|
| | Left | 27.6 | 54.9 | Breaker Millivolt Drop at 100 AMP DC Before Overload Test |
| | Center | 40.9 | 42.6 | |
| | Right | 37.6 | 29.6 | |
| | Left | 32.7 | 37.0 | Breaker Millivolt Drop at 100 AMP DC Following Overload Test (600 Volts/1500 Amps 50 On-Off Operations) No Significant Change |
| | Center | 27.1 | 28.7 | |
| | Right | 35.8 | 27.4 | |
| Temper- | Left | 61° C. | 61° C. | Temperature of Wire |

TABLE 2-continued

| | POLE | Breaker No. A | Breaker No. I | COMMENTS |
|---|---|---|---|---|
| ature @ 250 Amps Line Load | Center | 63 | 63 | Terminals of Breaker |
| | Right | 60 | 64 | Upper Limit 76° C. |
| | Left | 65 | 67 | |
| | Center | 69 | 67 | |
| | Right | 69 | 68 | |

In Table 2, temperatures after overload are listed. The higher the millivolt drop the hotter the breaker operates. The evaluation of the test data as well as the examination of the contacts after the test indicated that the temperature rise and erosion due to make-and-break were minimal, thereby making the contacts very favorable for the use intended.

With other contacts on the same test, the temperatures were as high as 85° C. which are unacceptable because they exceeded the upper limit, 76° C., a 50° C. rise.

In conclusion, the composite contact material of this invention consisting of a pair of contacts perform the actual duty of making, carrying, and breaking the circuit in a circuit breaker. The most important requirements of electrical contacts are electrical conductivity, thermal, and mechanical properties which the composite contact involving silver powder and graphite fibers of this invention satisfied.

What is claimed is:

1. A method of producing an electrical contact material of silver and graphite fiber which comprises the steps of mixing quantities of silver powder, graphite fiber particles, wetting agent powder, a solution of a lubricant and a solvent to provide a homogeneous mixture of ingredients and including from about 0.5 to about 10 weight percent of graphite fiber particles, from about 0.1 to about 3 weight percent of powdered wetting agent selected from the group consisting of Ni, Fe, Co, Cu, Au, and mixtures thereof, the solution being a slurry of a volatile hydrocarbon solvent and of a lubricant selected from the group consisting of polyethylene glycol, paraffin, and stearic acid, and the residual part consisting of silver powder;

drying the mixture of ingredients to eliminate the volatile solvent and to produce a dried mixture;

screening the dried mixture to agglomerate the ingredients into clusters;

pressing the dried mixture under a pressure of from about 7.5 to about 10 tons per square inch to form a solid briquet; heating the solid briquet from about 250° F. to about 450° F. for about one hour at each temperature of 250° F., 350° F., and 450° F., in air to bake out the lubricant;

sintering the solid briquet at temperature range of from about 1500° F. to 1700° F. in a reducing atmosphere to shrink the briquet to a higher density;

repressing the solid briquet under a pressure of about 50 tons per square inch to increase the density;

resintering the solid briquet at a temperature of from about 1500° F. to about 1700° F. in a reducing atmosphere to anneal stress from repressing; and re-repressing the solid briquet under a pressure of from about 50 to 60 tons per square inch.

2. The method of claim 1 wherein a solder shim is applied to one side of the solid briquet.

3. The method of claim 2 wherein there is from about 3 to 7 weight percent of graphite fiber.

4. The method of claim 3 wherein there is about 5 weight percent of graphite fiber.

5. The method of claim 4 wherein the graphite fiber is up to about 0.2 micrometers long.

6. The method of claim 5 wherein the sintering and resintering temperature is about 1600° F.

* * * * *